US007842449B2

(12) United States Patent
Hong et al.

(10) Patent No.: US 7,842,449 B2
(45) **Date of Patent: *Nov. 30, 2010**

(54) METHOD OF PREPARING TONER AND TONER PREPARED USING THE METHOD

(75) Inventors: Chang-kook Hong, Suwon-si (KR); Kyung-yol Yon, Seongnam-si (KR); Jun-young Lee, Seoul (KR); Min-young Cheong, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 672 days.

This patent is subject to a terminal disclaimer.

(21) Appl. No.: 11/482,712

(22) Filed: Jul. 10, 2006

(65) Prior Publication Data

US 2007/0026337 A1 Feb. 1, 2007

(30) Foreign Application Priority Data

Jul. 27, 2005 (KR) ..... 10-2005-0068642

(51) Int. Cl.
*G03G 9/087* (2006.01)

(52) U.S. Cl. ..... 430/137.17; 430/137.15

(58) Field of Classification Search ..... 430/137.17, 430/137.15

See application file for complete search history.

(56) References Cited

U.S. PATENT DOCUMENTS

| | | | | |
|---|---|---|---|---|
| 4,299,903 | A | 11/1981 | AuClair et al. | |
| 5,545,504 | A | 8/1996 | Keoshkerian et al. | |
| 6,132,919 | A | 10/2000 | Ogawa et al. | |
| 2005/0271970 | A1 * | 12/2005 | Lee et al. | 430/137.15 |
| 2006/0142470 | A1 * | 6/2006 | Sato et al. | 524/556 |

FOREIGN PATENT DOCUMENTS

| | | | |
|---|---|---|---|
| CN | 1637631 | | 7/2005 |
| EP | 0 952 495 | | 10/1999 |
| JP | 03-136065 | | 6/1991 |
| JP | 2003167381 | A * | 6/2003 |
| KR | 2000-0057424 | | 9/2000 |
| WO | WO 2005/029196 | | 3/2005 |
| WO | WO-2005/029196 | A1 * | 3/2005 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

Owen, David. Copies in Seconds. New York: Simon and Schuester (2004) pp. 166-175.*

Alger, Mark. Polymer Science Dictionary. London: Elsevier Applied Science. (1989) p. 146.*

English language amchine translation of JP 2003-167381 (Jun. 2003).*

* cited by examiner

*Primary Examiner*—Christopher RoDee
(74) *Attorney, Agent, or Firm*—Roylance, Abrams, Berdo & Goodman, L.L.P.

(57) ABSTRACT

A method of preparing a toner includes: preparing a toner composition including a macromonomer having a hydrophilic group, a hydrophobic group and at least one reactive functional group, at least one polymerizable monomer, and a colorant; emulsion-polymerizing the toner composition in a medium; and separating and drying the polymerized toner. A toner is prepared using the method. An image forming method using the toner, and an image forming apparatus using the toner are also provided. According to the method, the size, distribution and configuration of toner particles are easily controlled. In addition, the method does not involve the use of or minimizes the use of a surfactant, and decreases polluted water and waste water, which is very advantageous environmentally.

19 Claims, 1 Drawing Sheet

METHOD OF PREPARING TONER AND TONER PREPARED USING THE METHOD

CROSS-REFERENCE TO RELATED PATENT APPLICATION

This application claims the benefit of Korean Patent Application No. 10-2005-0068642, filed on Jul. 27, 2005, in the Korean Intellectual Property Office, the disclosure of which is hereby incorporated by reference in its entirety.

BACKGROUND OF THE INVENTION

1. Field of the Invention

The present invention relates to a method of preparing a toner and a toner prepared using the method. More particularly, the invention is directed to a method of preparing a toner using a macromonomer produced by emulsion polymerization, and a toner prepared using the method. The invention is also directed to an image forming method using the toner, and an image forming apparatus employing the toner.

2. Description of the Related Art

In an electrophotographic process or an electrostatic recording process, a developer used to form an electrostatic image or an electrostatic latent image may be a two-component developer formed of a toner and carrier particles or a one-component developer formed of a toner only, without carrier particles. The one-component developer may be a magnetic one-component developer having magnetic properties or a nonmagnetic one-component developer not having magnetic properties. Plasticizers such as colloidal silica are often added independently into the nonmagnetic one-component developer to increase the flowability of the toner. Generally, coloring particles obtained by dispersing a colorant, such as carbon black, or other additives in a binding resin are used in the toner.

Methods of preparing toners include pulverization or polymerization. In pulverization, the toner is obtained by melt mixing synthetic resins with colorants and, if needed, other additives, pulverizing the mixture and classifying the particles until a desired size of particles is obtained. In polymerization, a polymerizable monomer composition is manufactured by uniformly dissolving or dispersing a polymerizable monomer, a colorant, a polymerization initiator and, if needed, various additives such as a cross-linking agent and an antistatic agent. Next, the polymerizable monomer composition is dispersed in an aqueous dispersive medium which includes a dispersion stabilizer using an agitator to form minute liquid drop particles. Subsequently, the temperature is increased and suspension polymerization is performed to obtain a polymerized toner having coloring polymer particles of a desired size.

In an image forming apparatus such as an electrophotographic apparatus or an electrostatic recording apparatus, an electrostatic latent image is formed through light-exposure on the surface of a photoreceptor which is uniformly charged. A toner is attached to the electrostatic latent image, and a resulting toner image is transferred to a transfer medium such as a paper through several processes such as heating, pressing, solvent steaming, etc. In most fixing processes, the transfer medium with the toner image passes through fixing rollers and pressing rollers, and by heating and pressing, the toner image is fused to the transfer medium.

Improvements in preciseness and minuteness are required for images formed by an image forming apparatus such as an electrophotocopier. Conventionally, a toner used in an image forming apparatus is usually obtained by pulverization of the toner material. When using pulverization, it is likely to form coloring particles with a wide range of particle sizes. Hence, to obtain satisfactory developer properties, there is a need to classify the coloring particles obtained by pulverization according to size to obtain a narrow particle size distribution. However, it is difficult to precisely control the particle size distribution using a conventional mixing/pulverizing process in the manufacture of toner particles suitable for an electrophotographic process or electrostatic recording process. Also when preparing a minute particle toner, a toner preparation yield is low due to a classification process. In addition, there is a limit to a change/adjustment of a toner design for obtaining desirable charging and fixing properties. Accordingly, polymerized toners, in which the size of particles is easy to control and which do not need to go through a complex manufacturing process such as classification, have come into the spotlight recently.

When a toner is prepared by polymerization, the desired size distribution of particles is obtained without performing pulverization or classification.

U.S. Pat. No. 6,033,822 in the name of Hasegawa et al. discloses a polymerized toner including a core formed of colored polymer particles and a shell covering the core in molecules, wherein the polymerized toner is prepared by suspension polymerization. However, it is still difficult to adjust the shape of the toner and the sizes of the particles using the process. Also, this process produces a wide particle size distribution.

U.S. Pat. No. 6,258,911 in the name of Michael et al. discloses a bifunctional polymer having a narrow polydispersity and an emulsion-condensation polymerization process for manufacturing a polymer having covalently bonded free radicals on each of its ends. However, even when this method is used, a surfactant can cause an adverse effect, and it is difficult to control the size of the particles in the latex.

SUMMARY OF THE INVENTION

The present invention provides a method of preparing a toner in which the size of a toner particle is controlled freely and produces a narrow particle size distribution.

The present invention also provides a toner having a small particle size and excellent storage property and durability, in which the particle size of the toner can be easily controlled while being produced in a high yield.

The present invention also provides an image forming method in which a high quality image can be fixed at a low temperature by using a toner having superior properties in particle size control, storage property, and durability.

The present invention also provides an image forming apparatus in which a high quality image can be fixed at a low temperature by using a toner having superior properties in particle size control, storage property, and durability.

According to an aspect of the present invention, a method of preparing a toner includes: preparing a toner composition including a macromonomer having a hydrophilic group, a hydrophobic group and at least one reactive functional group, at least one polymerizable monomer, and a colorant; emulsion-polymerizing the toner composition in a medium; and separating and drying the polymerized toner.

According to another aspect of the present invention, a toner includes a copolymer of a macromonomer and a polymerizable monomer obtained by emulsion-polymerizing a toner composition in a medium, the toner composition comprising the macromonomer having a hydrophilic group, a hydrophobic group and at least one reactive functional group, at least one polymerizable monomer, and a colorant.

According to another aspect of the present invention, an image forming method includes forming a visible image by disposing a toner on a photoreceptor surface where an electrostatic latent image is formed; and transferring the visible image to a transfer medium, wherein the toner includes a copolymer of a macromonomer and a polymerizable monomer obtained by emulsion-polymerizing a toner composition in a medium, the toner composition including the macromonomer having a hydrophilic group, a hydrophobic group and at least one reactive functional group, at least one polymerizable monomer, and a colorant.

According to another aspect of the present invention, an image forming apparatus comprising: an organic photoreceptor; an image forming unit to form a electrostatic latent image on a surface of the organic photoreceptor; a toner cartridge to contain the toner; a toner supplying unit to supply the toner to the surface of the organic photoreceptor to develop said electrostatic latent image on the surface of the organic photoreceptor into a toner image; and a toner transferring unit to transfer the toner image on the surface of the organic photoreceptor to a transfer mediuman, wherein the toner includes a copolymer of a macromonomer and a polymerizable monomer obtained by emulsion-polymerizing a toner composition in a medium, the toner composition including the macromonomer having a hydrophilic group, a hydrophobic group and at least one reactive functional group, at least one polymerizable monomer, and a colorant.

According to the present invention, a toner having a small particle size and excellent storage property and durability can be prepared. The particle size of the toner can be easily controlled. The toner is environment-friendly and can be produced through a simplified processes. Therefore, the production cost is low.

These and other aspects of the invention will become apparent from the following detailed description of the invention and the annexed drawing which discloses various embodiments of the invention.

BRIEF DESCRIPTION OF THE DRAWING

The above and other features and advantages of the present invention will become more apparent by describing in detail exemplary embodiments thereof with reference to the attached drawing in which.

DETAILED DESCRIPTION OF THE INVENTION

Figure 1:
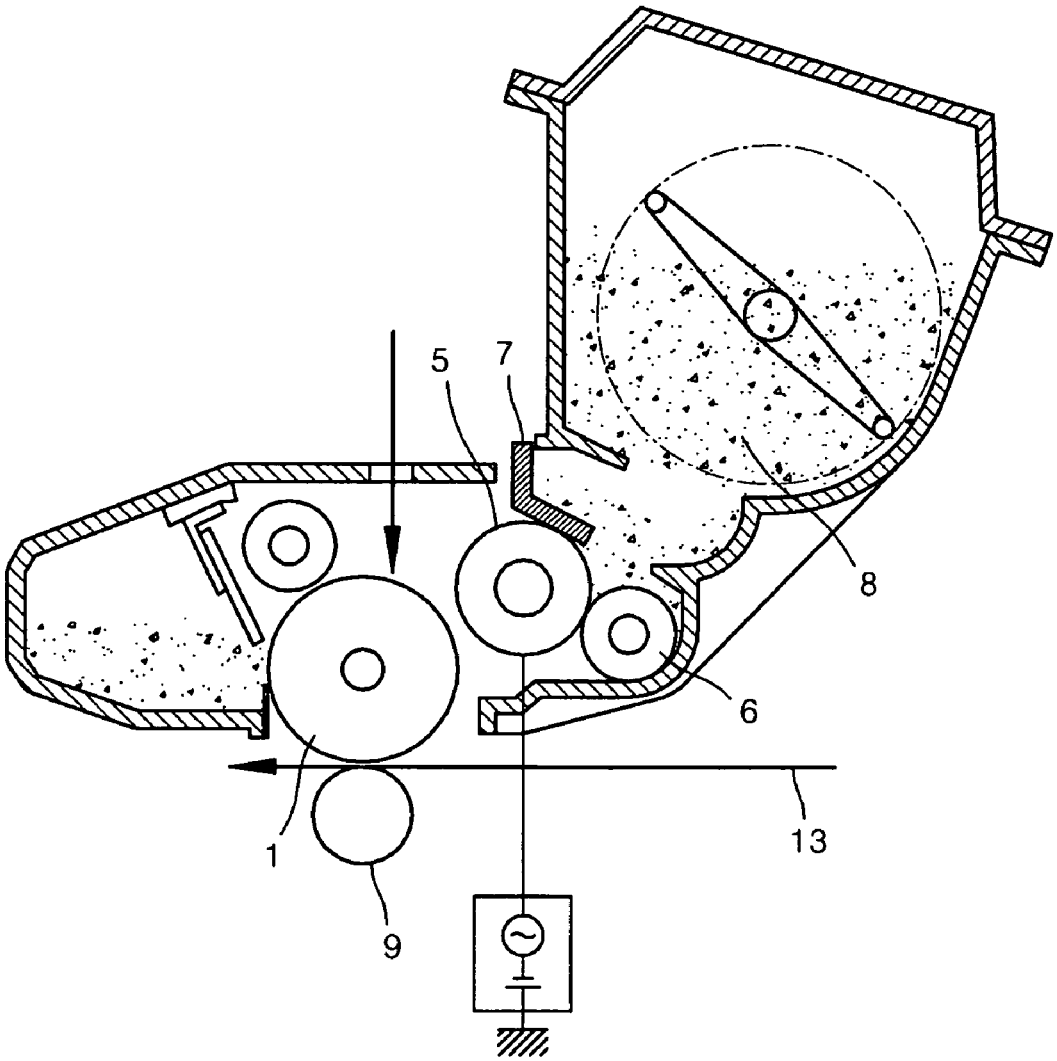
FIG. 1 is a schematic diagram of an image forming apparatus employing a toner prepared using a method according to an embodiment of the present invention.

The present invention provides a method of preparing a toner including: preparing a toner composition including a macromonomer having a hydrophilic group, a hydrophobic group and at least one reactive functional group, at least one polymerizable monomer and a colorant; emulsion polymerizing the toner composition in a medium; and separating and drying the polymerized toner.

The method of preparing the toner is based on an emulsion polymerization step. The resulting macromonomer obtains new characteristics during the emulsion polymerization process that are not obtained by the prior processes. The macromonomer according to an embodiment of the present invention is an amphipathic material having both a hydrophilic group and a hydrophobic group, and a polymer or an oligomer having at least one reactive functional group. The hydrophilic group reacts with a medium, and the hydrophobic group promotes the emulsion polymerization by existing on the surface of the toner particles. The macromonomer can form a copolymer by binding with a polymerizable monomer in the toner composition in various ways, such as grafting, branching or cross-linking. By using the macromonomer according to an embodiment of the present invention, the durability and anti-offset of toner particles can be improved. Also, the macromonomer can act as a stabilizer by forming stabilized micelles during the emulsion polymerization.

The weight average molecular weight of the macromonomer is in the range of 100 to 100,000, and preferably in the range of 1,000 to 10,000. When the weight average molecular weight of the macromonomer is less than 100, the properties of the toner may not be improved or the macromonomer may not operate properly as a stabilizer. Also, when the weight average molecular weight of the macromonomer is greater than 100,000, a reaction conversion rate may be low.

The macromonomer according to an embodiment of the present invention may be, for example, a material selected from the group consisting of polyethylene glycol (PEG)-methacrylate, PEG-ethyl ether methacrylate, PEG-dimetacrylate, PEG-modified urethane, PEG-modified polyester, polyacrylamide (PAM), PEG-hydroxyethyl methacrylate, hexafunctional polyester acrylate, dendritic polyester acrylate, carboxy polyester acrylate, fatty acid modified epoxy acrylate and polyester methacrylate, but is not limited thereto.

The amount of the macromonomer used in an embodiment of the present invention may be in the range of 1 to 50 parts by weight based on 100 parts by weight of the toner composition. When the amount of the macromonomer is less than 1 part by weight based on 100 parts by weight of the toner composition, the stability of the particle distribution is low, and when the amount of the macromonomer exceeds 50 parts by weight based on 100 parts by weight of the toner composition, the property of the toner deteriorates.

The polymerizable monomer used in an embodiment of the present invention may be a monomer selected from the group consisting of a vinyl monomer, a polar monomer having a carboxyl group, a monomer having an unsaturated polyester group and a monomer having a fatty acid group.

The polymerizable monomer, may be formed of at least one material selected from the group consisting of styrene-based monomer such as styrene, vinyltoluene, and α-methylstyrene; acrylic acid and methacrylic acid; (meth)acrylic acid derivative such as methylacrylate, ethylacrylate, propylacrylate, butylacrylate, 2-ethlyhexylacrylate, dimethylaminoethylacrylate, methylmethacrylate, ethylmethacrylate, propylmethacrylate, butylmethacrylate, 2-ethlyhexylmethacrylate, dimethylaminoethylmethacrylate; (meth) acrylic acid derivative of amide selected from the group consisting of acrylonitrile, methacrylonitrile, acrylamide and methacrylamide; ethylenically unsaturated monoolefin such as ethylene, propylene and butylene; halogenated vinyl such as vinyl chloride, vinylidene chloride and vinyl fluoride; vinyl ester such as vinyl acetate and vinyl propionate; vinyl ether such as vinyl methyl ether and vinyl ethyl ether; vinyl ketone such as vinyl methyl ketone and methyl isopropenyl ketone; vinyl compound having nitrogen such as 2-vinyl pyridine, 4-vinyl pyridine and N-vinyl pyrrolidone, but is not limited thereto.

The amount of the polymerizable monomer used in an embodiment of the present invention is in the range of 3 to 50 parts by weight based on 100 parts by weight of the toner composition. When the amount of the polymerizable monomer is less than 3 parts by weight based on 100 parts by weight of the toner composition, the yield is low. When the amount of the polymerizable monomer exceeds 50 parts by weight based on 100 parts by weight of the toner composition, the stability of the toner composition is low.

The medium used in an embodiment of the present invention may be an aqueous solution or a mixture of water and an organic solvent.

The method of preparing a toner composition can be executed in various ways. According to an embodiment of the present invention, the toner composition can be prepared by manufacturing a colorant dispersion by mixing the colorant and the initiator in the medium, and adding at least one polymerizable monomer and macromonomer into the colorant dispersion.

According to another embodiment of the present invention, the toner composition can be prepared by manufacturing a colorant dispersion by mixing the colorant, the initiator and the macromonomer in the medium, and adding at least one polymerizable monomer into the colorant dispersion.

According to another embodiment of the present invention, the process for preparing the toner composition includes: preparing a composition including at least one polymerizable monomer and the colorant in a medium containing the macromonomer; and adding a free radical initiator into the composition.

In detail, while purging a reactor with nitrogen gas, a colorant dispersion is injected into the reactor and water or a mixture of water and a solvent is added thereto, and the resultant reaction medium is mixed. At this time, an electrolyte such as NaCl or an ionic salt can be added to control the ionic strength of a reaction medium. When the temperature inside the reactor reaches an appropriate value, an initiator is injected, such as a water soluble free radical initiator. Subsequently, a dispersion, which is a mixture of a macromonomer and a reactive monomer, is injected into the reactor. To control the reaction rate and the degree of dispersion, before injecting the initiator, the macromonomer can be dispersed in the medium inside the reactor beforehand.

An amphipathic macromonomer can act not only as a comonomer but also as a stabilizer. The reaction between initial radicals and monomers forms oligomer radicals, and provides an in situ stabilizing effect. The initiator decomposed by heat forms a radical, reacts with a monomer unit in an aqueous solution to form an oligomer radical, and increases hydrophobicity. The hydrophobicity of the oligomer radical accelerates the diffusion inside the micelle, accelerates the reaction with polymerizable monomers and facilitates a copolymerization reaction with a macromonomer.

The hydrophilicity of an amphipathic macromonomer enables the copolymerization reaction to occur easily in the vicinity of the surface of toner particles. The hydrophilic portion of the macromonomer located on the surface of the particle increases the stability of the toner particle by providing steric stability, and can control the particle size according to the amount or molecular weight of the injected macromonomer. Also, the functional group which reacts on the surface of the particle can improve the frictional electricity properties of the toner.

Radicals in the toner composition are formed by the initiator, and the radical may react with the polymerizable monomer. The radical reacts with the polymerizable monomer and the reactive functional group of the macromonomer to form a copolymer.

Examples of the radical polymerized initiator include persulfates, such as potassium persulfate, ammonium persulfate, etc.; azo compounds, such as 4,4-azobis (4-cyanovaleric acid), dimethyl-2,2'-azobis (2-methylpropionate), 2,2-azobis (2-amidinopropane) dihydrochloride, 2,2-azobis-2-methyl-N-1,1-bis (hydroxymethyl)-2-hydroxyethylpropionamide, 2,2'-azobis (2,4-dimethylvaleronitrile), 2,2'-azobisisobutyronitrile, 1,1'-azobis (1-cyclohexanecarbonitrile), etc.; peroxides, such as methylethylperoxide, di-t-butylperoxide, acetylperoxide, dicumylperoxide, lauroylperoxide, benzoylperoxide, t-butylperoxide-2-ethylhexanoate, di-isopropylperoxydicarbonate, di-t-butylperoxyisophthalate, etc. Also, an oxidation-reduction initiator, which is a combination of a polymerized initiator and a reducing agent, may be used.

The emulsion polymerization of the method of preparing a toner according to an embodiment of the present invention does not involve the use of an emulsifier. In another embodiment, the amount of an emulsifier is minimized as compared to the prior processes. By not using the emulsifier in the emulsion polymerization, a cleaning process during separation and filtration processes of the toner particles prepared after the reaction is not required or is minimized. By minimizing the cleaning process, the preparation process is simplified and the production costs can be reduced. Also, by reducing polluted water and waste water, it is very advantageous environmentally. In addition, by not using or minimizing the use of the emulsifier, problems such as sensitivity to humidity, low triboelectric charge, decrease in induced electricity and weak toner flow can be prevented, and the storage stability of the toner can be improved remarkably.

A developer according to an embodiment of the present invention may include a colorant, and such a colorant may be carbon black or aniline black in the case of a black toner. Also, it is easy to produce a color toner with a nonmagnetic toner according to an embodiment of the present invention. In the case of a color toner, carbon black is used as a colorant for black. A yellow colorant, a magenta colorant and a cyan colorant are also included as suitable colorants for the colors.

The yellow colorant may be a condensed nitrogen compound, an isoindolinone compound, an anthraquinone compound, an azo metal complex, or an aryl imide compound. Suitable examples include C.I. pigment yellow 12, 13, 14, 17, 62, 74, 83, 93, 94, 95, 109, 110, 111, 128, 129, 147, 168, 180, etc. may be used.

The magenta colorant may be a condensed nitrogen compound, anthraquinone, a quinacridone compound, a lake pigment of basic dye, a naphthol compound, a benzoimidazole compound, a thioindigo compound, or a perylene compound. Suitable examples include C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, etc. may be used.

The cyan colorant may be a copper phthalocyanine compound or a derivative thereof, an anthraquinone compound, or a lake pigment of basic dye. Suitable examples include C.I. pigment blue 1, 7, 15, 15:1, 15:2, 15:3, 15:4, 60, 62, 66, etc. may be used.

These colorants may be used alone or in combinations of two or more types. A desired colorant is selected considering color, saturation, brightness, weatherability, and dispersability in a toner.

The amount of the colorant may be in the range of 0.1 to 20 parts by weight based on the 100 parts by weight of a polymerizable monomer. The amount of the colorant is not particularly limited as long as it is sufficient to color the toner. When the amount of the colorant is less than 0.1 parts by weight, the coloring is insufficient. When the amount of the colorant exceeds 20 parts by weight, the production costs of the toner increases and the toner is unable to obtain enough triboelectric charge.

The toner composition according to an embodiment of the present invention may include at least one material selected from the group consisting of wax, a charge control agent and a release agent.

The release agent protects a photoreceptor and prevents deterioration of developing properties, and thus may be used for the purpose of obtaining a high quality image. A release agent according to an embodiment of the present invention may use a solid fatty acid ester material with high purity. In detail, a low molecular weight polyolefin, such as low molecular weight polyethylene, low molecular weight polypropylene, low molecular weight polybutylene, etc.; paraffin wax; or a multifunctional ester compound, etc. may be used. The release agent used in an embodiment of the present invention may be a multifunctional ester compound formed of an alcohol having at least three functional groups and a carboxylic acid.

The polyhydric alcohol with at least three functional groups may be an aliphatic alcohol, such as glycerin, pentaerythritol, pentaglycerol, etc.; an alicyclic alcohol, such as chloroglycitol, quersitol, inositol, etc.; an aromatic alcohol, such as tris (hydroxymethyl) benzene, etc.; a sugar, such as D-erythrose, L-arabinose, D-mannose, D-galactose, D-fructose, sucrose, maltose, lactose, etc.; or a sugar-alcohol, such as erythrite, etc.

The carboxylic acid may be an aliphatic carboxylic acid, such as acetic acid, butyric acid, caproic acid, enantate, caprylic acid, pelargonic acid, capric acid, undecanoic acid, lauric acid, myristic acid, stearic acid, magaric acid, arachidic acid, cerotic acid, sorbic acid, linoleic acid, linolenic acid, behenic acid, tetrolic acid, etc.; an alicyclic carboxylic acid, such as cyclohexanecarboxylic acid, hexahydroisophthalic acid, hexahydroterephthalic acid, 3,4,5,6-tetrahydrophthalic acid, etc.; or an aromatic carboxylic acid, such as benzoic acid, cumic acid, phthalic acid, isophthalic acid, terephthalic acid, trimeth acid, trimellitic acid, hemimellitic acid, etc.

The charge control agent may be formed of a material selected from the group consisting of a salicylic acid compound containing a metal, such as zinc or aluminum, a boron complex of bisdiphenylglycolic acid, and silicate. More particularly, dialkyl salicylic acid zinc or borobis (1,1-diphenyl-1-oxo-acetyl potassium salt) may be used.

A suitable wax which provides a desired characteristic of the final toner compound may be used. The wax may be polyethylene wax, polypropylene wax, silicon wax, paraffin wax, ester wax, carnauba wax or metallocene wax, but is not limited thereto. The melting point of the wax may be in the range of about 50 to about 150° C. Wax components physically adhere to the toner particles, but do not covalently bond with the toner particles. The toner fixes to a final image receptor at a low fixation temperature and has superior final image durability and antiabrasion property.

The polymerizing reaction may be performed for 3 to 12 hours according to the temperature. Particles obtained as a product of the reaction are filtered, separated and dried. At this time, an agglomeration process may be performed to control the particle size. An additive may be further added to the dried toner for use in a laser printer. The average volumetric particle size of the toner prepared according to an embodiment of the present invention may be in the range of 0.5 to 20 μm, and preferably, in the range of 5 to 10 μm.

The present invention provides a toner including a copolymer of a macromonomer and a polymerizable monomer obtained by emulsion-polymerizing a toner composition in a medium, the toner composition including the macromonomer having a hydrophilic group, a hydrophobic group and at least one reactive functional group, at least one polymerizable monomer, and a colorant.

A radical formed by an initiator reacts with the polymerizable monomer, and the reactive functional group of the macromonomer, and may form a copolymer. The copolymer may be formed by copolymerizing at least one monomer selected from the group consisting of a vinyl monomer, a polar monomer having a carboxyl group, a monomer having an unsaturated polyester group and a monomer having a fatty acid group. The weight average molecular weight of the copolymer may be in the range of 2,000 to 200,000.

The weight average molecular weight of the macromonomer may be in the range of 100 to 100,000, and is preferably in the range of 1,000 to 10,000. The macromonomer may be formed of a material selected from the group consisting of polyethylene glycol (PEG)-methacrylate, PEG-ethyl ether methacrylate, PEG-dimethacrylate, PEG-modified urethane, PEG-modified polyester, polyacrylamide (PAM), PEG-hydroxyethyl methacrylate, hexafunctional polyester acrylate, dendritic polyester acrylate, carboxy polyester acrylate, fatty acid modified epoxy acrylate and polyester methacrylate, but is not limited thereto.

The toner composition may further include at least one material selected from the group consisting of wax, a charge control agent and a release agent. The details thereof are as described above.

The present invention provides an image forming method including forming a visible image by depositing a toner on the surface of a photoreceptor having an electrostatic latent image formed thereon; and transferring the visible image to the transfer medium. The toner used in the method contains a copolymer of a macromonomer and a polymerizable monomer that is obtained through emulsion polymerization of a toner composition including the macromonomer having a hydrophilic group, a hydrophobic group and at least one reactive functional group, and at least one polymerizable monomer and colorant in a medium.

An electrophotographic image forming process includes a charging process, a light-exposing process, a developing process, a transferring process, a fixing process, a cleaning process and an antistatic process, which are series of processes to form an image on an image receptor.

In the charging process, the photoreceptor is covered with electric charges of desired polarity, either negative or positive, by a corona or a charging roller. In the light-exposing process, an optical system, generally a laser scanner or an array of diodes, forms a latent image corresponding to a final visual image to be formed on an image receptor by selectively discharging the charging surface of the photoreceptor in an imagewise manner. Electromagnetic radiation (hereinafter, "light") may include infrared radiation, visible rays and ultraviolet radiation.

In the developing process, in general, the toner particles with suitable polarity contact the latent image on the photoreceptor, and typically, an electrically biased developer which has a potential with the same polarity as the toner is used. The toner particles move to the photoreceptor, selectively adhere to the latent image through static electricity and form a toner image on the photoreceptor.

In the transferring process, the toner image is transferred from the photoreceptor to a desired final image receptor. Sometimes an intermediate transferring element is used to effect the transfer of the toner image from the photoreceptor to the final image receptor.

In the fixing process, the toner image is fixed to the final image receptor by melting or softening the toner particles by heating the toner image on the final image receptor. Alternatively, the toner can be fixed to the final image receptor under high pressure while being heated or unheated. In the cleaning process, the toner particles remaining on the photoreceptor are removed. In the antistatic process, an electric charge on the photoreceptor is exposed to light of a certain wavelength, and the electric charge is substantially decreased to a uniform low value. Consequentially, a residue of the latent image is removed and the photoreceptor is prepared for the image forming cycle.

The present invention also provides an image forming apparatus comprising: an organic photoreceptor; an image forming unit to form a electrostatic latent image on a surface of the organic photoreceptor; a toner cartridge to contain the toner; a toner supplying unit to supply the toner to the surface of the organic photoreceptor to develop said electrostatic latent image on the surface of the organic photoreceptor into a toner image; and a toner transferring unit to transfer the toner image on the surface of the organic photoreceptor to a transfer mediuman, wherein the toner includes a copolymer of a macromonomer and a polymerizable monomer obtained by emulsion-polymerizing a toner composition in a medium, the toner composition including the macromonomer having a hydrophilic group, a hydrophobic group and at least one reactive functional group, at least one polymerizable monomer, and a colorant.

FIG. 1 is a schematic diagram of a non-contact developing type image forming apparatus using a toner prepared using the method according to an embodiment of the present invention. The operating principles of the image forming apparatus are explained below.

A developer 8, which is a nonmagnetic one-component developer, is supplied to a developing roller 5 through a feeding roller 6 formed of an elastic material such as polyurethane form and sponge. The developer 8 supplied to the developing roller 5 reaches a contact point between the developing roller 5 and a developer regulation blade 7 as the developing roller 5 rotates. The developer regulation blade 7 is formed of an elastic material such as metal, rubber, etc. When the developer 8 passes the contact point between the developing roller 5 and the developer regulation blade 7, the developer 8 is smoothed to form a thin layer and the developer 8 is sufficiently charged. The developing roller 5 transfers the thin layer of the developer 8 to a developing domain where the developer 8 is developed on the electrostatic latent image of a photoreceptor 1, which is a latent image carrier.

The developing roller 5 and the photoreceptor 1 face each other with a constant distance therebetween without contact. The developing roller 5 rotates counterclockwise and the photoreceptor 1 rotates clockwise. The developer 8 transferred to the developing domain forms an electrostatic latent image on the photoreceptor 1 according to the intensity of an electric charge generated due to a difference between a voltage applied to the developing roller 5 and a latent image potential of the photoreceptor 1.

The developer 8 developed on the photoreceptor 1 reaches a transferring device 9 as the photoreceptor 1 rotates. The developer 8 developed on the photoreceptor 1 is transferred through corona discharging or by a roller to a printing paper 13 as the printing paper 13 passes between the photoreceptor 1 and the transferring device 9 by the transferring device 9 to which a high voltage with an opposite polarity to the developer 8 is applied, and thus forms an image.

The image transferred to the printing paper 13 passes through a fusing device (not shown) that provides high temperature and high pressure, and the image is fused to the printing paper 13 as the developer 8 is fused to the printing paper 13. Meanwhile, remaining developer 8 on the developing roller 5 which is not developed is taken back by the feeding roller 6 contacting the developing roller 5. The above processes are repeated.

The present invention will now be described in greater detail with reference to the following examples. The following examples are for illustrative purposes only and are not intended to limit the scope of the invention.

EXAMPLES

Example 1

100 g of a mixture of monomers including styrene, butylacrylate and methacrylic acid in a ratio of 7:2:1, 5 g of polyethylene glycol-methacrylate (PEG-MA) as a macromonomer, and 2.5 g of 1-dodecanethiol as a chain transfer agent, were mixed. 8 g of cyan pigment, PB 15:3 and the mixture containing the monomer mixture, the PEG-MA and the 1-dodecanethiol were mixed, and the pigment was dispersed in a dispersing mixer (Dispermat Milling) at 5,000 RPM for about an hour. The dispersed solution was mixed with 10 g of ester wax while being heated at a temperature of over 80° C. to obtain a monomer pigment mixture. 5 g of PEG-MA was dissolved and mixed in 500 g of ultra-high pure water that was deoxidized by ultra-high pure nitrogen to be put in a reactor. The prepared aqueous solution and the monomer pigment mixture were mixed in a 1-L reactor and were homogenized using a homogenizer. The homogenization was performed for 30 minutes at 7,000 RPM. The resultant mixture was put into the reactor, and simultaneously stirred at 300 RPM and heated to 80° C. When the internal temperature of the reactor reached an appropriate value, 1 g of potassium persulfate and 0.5 g of 2,2'-azobisisobutyronitrile were added as an initiator, and the reactor was purged with nitrogen gas. The reaction was performed for 8 hours, and after the reaction was completed, the product was allowed to cool naturally while stirring. The average volumetric particle size of particles obtained through this process was 6.6 μm, the ratio (dv/dn) of volume average size to number average size was 1.19, Tg was 53.5° C., and the conversion ratio was 95%.

Example 2

A toner composition was prepared in the same manner as in Example 1 except that, after the reaction was performed for 2 hours, a mixture of 15 g of styrene, 3 g of butylacrylate, 0.5 g of methylacrylate, 0.5 g of PEG-MA, and 2.5 g of dodecanethiol as a monomer for shell layer was added. The reaction time was 6 hours, and the temperature was maintained at 80° C. during the reaction. After 6 hours, the reactor was no longer heated and was allowed to cool naturally. The average volumetric particle size of particles was 6.9 μm, the number average size was 6.7 μm, and Tg was 56.3° C.

Example 3

A toner composition was prepared in the same manner as in Example 1, except that PEG-ethyl ether methacrylate (EEMA) was used instead of PEG-MA. Also, instead of ester wax, 8 g of polyethylene wax was used. The average volumetric particle size of the particles manufactured was 6.3 μm, the number average size was 6.1 μm, Tg was 50.6° C. and the conversion ratio was 98%.

Example 4

A toner composition was prepared in the same manner as in Example 1, except that polyacrylamide (PAM) 100 (Rhodia) was used instead of PEG-MA. Also, instead of 10 g of ester wax, 11 g of polyethylene wax was used. The average volumetric particle size of the particles manufactured was 6.8 μm, the number average size was 6.5 μm, and Tg was 56.3° C.

Example 5

A toner composition was prepared in the same manner as in Example 1, except that PEG-hydroxyethyl methacrylate was used instead of PEG-MA. The PEG-hydroxyethyl methacrylate was dissolved in 10 g of ethanol and then in water. The average volumetric particle size of the particles manufactured was 6.8 μm and Tg was 50° C.

Example 6

A toner composition was prepared in the same manner as in Example 1, except that acrylic acid was used instead of methacrylic acid. The average volumetric particle size of the particles manufactured was 6.5 μm, the number average size was 6.4 μm and Tg was 46° C.

Example 7

A toner composition was prepared in the same manner as in Example 1, except that PY 180 was used as the pigment instead of PB 15:3. The average volumetric particle size of the particles manufactured was 5.5 μm, the number average size was 5.2 μm and Tg was 53.5° C.

Example 8

A toner composition was prepared in the same manner as in Example 1, except that PR122 was used as the pigment instead of PB 15:3. The average volumetric particle size of the particles manufactured was 6.6 μm, the number average size was 6.3 μm and Tg was 53.5° C.

Example 9

A toner composition was prepared in the same manner as in Example 1, except that carbon black (Nipex 70) was used instead of PB 15:3 for the pigment. The average volumetric particle size of the particles manufactured was 6.7 μm, the number average size was 6.5 μm and Tg was 53.5° C.

Example 10

30 g of PB 15:3 as a cyan pigment, 100 g of water and 10 g of PEG-MA as a macromonomer were milled by Dispermat Milling at 5,000 RPM for about an hour using 200 g of glass beads to prepare a pigment water-dispersion. 20 g of the pigment water-dispersion was mixed with 450 g of ultra-high pure water which was deoxidized by ultra-high pure nitrogen, and the result was put into a one-liter reactor to be stirred and heated to 80° C. 100 g of a monomer mixture containing styrene, butylacrylate and methylacrylate at a ratio of 7:2:1, 5 g of PEG-MA and 2.5 g of 1-dodecanethiol were added to the one-liter reactor. 10 g of ester wax was heated and mixed with the mixed solution. 1 g of NaCl was added to the heated one-liter reactor. 1 g of potassium persulfate and 0.5 g of 2,2'-azobisisobutyronitrile as an initiator were dissolved in 30 g of water, and the result was added to the one-liter reactor. The prepared monomer mixture was dropwise added to the one-liter reactor for about an hour using a dropwise adding funnel. At this time, stirring was performed at 300 RPM and the reaction temperature was maintained at 80° C. Nitrogen gas was purged inside the one-liter reactor. The reaction was performed for 8 hours, and after the reaction was completed, the product was allowed to cool naturally while stirring. The average volumetric particle size of obtained particles was 6.9 μm, Tg was 50° C., and the conversion ratio was 91%.

Comparative Example

Conventional Emulsion/Aggregation Process

Preparation of Latex 0.5 g of sodium dodecyl sulfate (SDS) as an anionic surfactant, was mixed in 400 g of ultra-high pure water that was deoxidized. Styrene, butylacrylate and methacrylic acid, which are monomers were mixed together and put in a dropwise adding funnel. The aqueous solution was put into a reactor and heated to 80° C. When the temperature reached 80° C., an initiator, which was a solution of 0.2 g of potassium persulfate in 30 g of ultra-high pure water, was added. After 10 minutes, 30 g of a mixed monomer was dropwise added for about 30 minutes. After allowing a reaction to occur for 4 hours, the heating was stopped and the product was allowed to cool naturally. 30 g of the resultant seed solution was removed and added to 351 g of ultra-high pure water, and the result was heated to 80° C. 17 g of ester wax was heated and dissolved together with 18 g of monomer styrene, 7 g of butylacrylate, 1.3 g of methacrylic acid, and 0.4 g of dodecanethiol. The prepared wax/mixed monomer was added to 220 g of ultra-high pure water in which 1 g of SDS was dissolved, and the result was homogenized for about 10 minutes in an ultrasonic homogenizer. The homogenized emulsified solution was put into the reactor and after about 15 minutes, 5 g of the initiator and 40 g of ultra-high pure water were mixed and added to the reactor. During this time, the reaction temperature was maintained at 82° C. and the reaction was allowed to continue thereafter for about 2 hours and 30 minutes. After the reaction was performed for 2 hours and 30 minutes, 1.5 g of the initiator and 60 g of ultra-high pure water were again added together with a monomer for shell layer formation. The monomer was composed of 56 g of styrene, 20 g of butylacrylate, 4.5 g of methacrylic acid, and 3 g of dodecanethiol. The monomer was dropwise added to the reactor for about 80 minutes. After the reaction was performed for two hours, the reaction was stopped and the product was allowed to cool naturally.

Toner Aggregation/Melting Process 318 g of latex particles prepared as described above were mixed with ultra-high pure water in which 0.5 g of an SDS emulsifier was dissolved. 18.2 g of pigment particles (cyan 15:3, 40 solidity %) dispersed by the SDS emulsifier were added to obtain a latex pigment dispersed aqueous solution. While stirring at 250 RPM, the pH of the latex pigment dispersed aqueous solution was titrated to pH 10 using a 10% NaOH buffer solution. 30 g of ultra-high pure water was dissolved in 10 g of $MgCl_2$ as an aggregating agent, and the result was dropwise added to the latex pigment aqueous solution for about 10 minutes. The temperature of the result was increased to 95° C. at a rate of 10° C./min. After about 3 hours of heating, the reaction was stopped and the product was allowed to cool naturally. The average volumetric particle size was about 6.5 μm and Tg was 53.5° C.

From Examples 1 through 10, it can be seen that the formation and size of particles of a toner can be controlled, and relative to the Comparative Example, fixability at a low temperature is improved. Hence, optimization according to a printer setting is possible.

According to the present invention, the formation and size of toner particles can be easily controlled, a cleaning process is simplified since the use of surfactant s is not required, production costs for toner preparation are low and the generation of polluted water and waste water is decreased, which is very advantageous environmentally. The anti-offset properties, triboelectric charge properties and storage stability of the toner are superior and allow the realization of high quality images. Also, a polymerized toner with superior properties can be prepared under a high humidity condition.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of preparing a toner comprising:

preparing a toner composition including a macromonomer having a hydrophilic group, a hydrophobic group and at least one reactive functional group, at least one polymerizable monomer, an initiator and a colorant;

emulsion-polymerizing the toner composition in a medium to produce a polymerized toner; and separating and drying the polymerized toner, wherein the macromonomer is a material selected from the group consisting of polyethylene glycol (PEG)-methacrylate, PEG-ethyl ether methacrylate, PEG-dimethacrylate, PEG-modified urethane, PEG-modified polyester, PEG-hydroxyethyl methacrylate, hexafunctional polyester acrylate, dendritic polyester acrylate, carboxy polyester acrylate, fatty acid modified epoxy acrylate, and polyester methacrylate.

2. The method of claim 1, wherein a radical is generated from the toner composition by said initiator and the radical reacts with the polymerizable monomer.

3. The method of claim 2, wherein the radical reacts with the polymerizable monomer and the at least one reactive functional group of the macromonomer to form a copolymer.

4. The method of claim 1, wherein the emulsion polymerization is carried out without adding an additional emulsifier to the toner composition.

5. The method of claim 1, wherein the medium is an aqueous solution, or a mixture of water and an organic solvent.

6. The method of claim 1, wherein the weight average molecular weight of the macromonomer is in the range of 100 to 100,000.

7. The method of claim 1, wherein the weight average molecular weight of the macromonomer is in the range of 1,000 to 10,000.

8. The method of claim 1, wherein the amount of the macromonomer is in the range of 1 to 50 parts by weight based on 100 parts by weight of the toner composition.

9. The method of claim 1, wherein the polymerizable monomer comprises at least one monomer selected from the group consisting of a vinyl monomer, a polar monomer having a carboxyl group, a monomer having unsaturated polyester, and a monomer having a fatty acid group.

10. The method of claim 9, wherein the polymerizable monomer comprises at least one material selected from the group consisting of a styrene-based monomer selected from the group consisting of styrene, vinyltoluene, and α-methylstyrene; acrylic acid; methacrylic acid; a (meth)acrylic acid derivative selected from the group consisting of methylacrylate, ethylacrylate, propylacrylate, butylacrylate, 2-ethylhexylacrylate, dimethylaminoethylacrylate, methylmethacrylate, ethylmethacrylate, propylmethacrylate, butylmethacrylate, 2-ethlyhexylmethacrylate, and dimethylaminoethylmethacrylate; a (meth)acrylic acid derivative of amide selected from the group consisting of acrylonitrile, methacrylonitrile, acrylamide and methacrylamide; an ethylenically unsaturated monoolefin selected from the group consisting of ethylene, propylene and butylene; a halogenated vinyl selected from the group consisting of vinyl chloride, vinylidene chloride and vinyl fluoride; a vinyl ester selected from the group consisting of vinyl acetate and vinyl propionate; a vinyl ether selected from the group consisting of vinyl methyl ether and vinyl ethyl ether; a vinyl ketone selected from the group consisting of vinyl methyl ketone and methyl isopropenyl ketone; and a vinyl compound having nitrogen selected from the group consisting of 2-vinyl pyridine, 4-vinyl pyridine and N-vinyl pyrrolidone.

11. The method of claim 1, wherein the amount of the polymerizable monomer is in the range of 3 to 50 parts by weight based on 100 parts by weight of the toner composition.

12. The method of claim 1, wherein the colorant comprises one material selected from the group consisting of yellow, magenta, cyan and black pigment.

13. The method of claim 12, wherein the amount of the colorant is in the range of 0.1 to 20 parts by weight based on 100 parts by weight of the toner composition.

14. The method of claim 1, wherein the average volumetric particle size of the polymerized toner is in the range of 0.5 to 20 μm.

15. The method of claim 1, wherein the average volumetric particle size of the polymerized toner is in the range of 5 to 10 μm.

16. The method of claim 1, wherein the toner composition further comprises at least one material selected from the group consisting of wax, a charge control agent, and a release agent.

17. The method of claim 1, wherein the preparation of the toner composition comprises:

manufacturing a colorant dispersion by mixing the colorant and an initiator in the medium; and adding at least one polymerizable monomer and the macromonomer to the colorant dispersion.

18. The method of claim 1, wherein the preparation of the toner composition comprises:

manufacturing a colorant dispersion by mixing the colorant, an initiator and the macromonomer in the medium; and adding at least one polymerizable monomer to the colorant dispersion.

19. The method of claim 1, wherein the preparation of the toner composition comprises:

preparing a composition including at least one polymerizable monomer and the colorant in a medium containing the macromonomer; and adding a free radical initiator into the composition.

* * * * *